US006254094B1

(12) United States Patent
Becker et al.

(10) Patent No.: US 6,254,094 B1
(45) Date of Patent: Jul. 3, 2001

(54) METHOD AND DEVICE FOR TRANSFERRING A TRAILING EDGE OF A SHEET IN A REVERSING DEVICE OF A SHEET-FED ROTARY PRINTING MACHINE

(75) Inventors: Willi Becker, Bammental; Andreas Fricke, Eberbach, both of (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/363,983

(22) Filed: Jul. 28, 1999

(30) Foreign Application Priority Data

Jul. 28, 1998 (DE) ..... 198 33 901

(51) Int. Cl.[7] ..... B65H 29/00; B65H 29/54
(52) U.S. Cl. ..... 271/309; 271/189
(58) Field of Search ..... 271/309, 189

(56) References Cited

U.S. PATENT DOCUMENTS

| | | | | |
|---|---|---|---|---|
| 3,506,259 | * | 4/1970 | Caldwell et al. | 271/51 X |
| 3,804,401 | * | 4/1974 | Stange | 271/80 X |
| 3,955,813 | * | 5/1976 | Edwards | 271/174 X |
| 4,310,152 | * | 1/1982 | Mitzel | 271/186 |
| 4,786,046 | * | 11/1988 | Freeman et al. | 271/276 X |
| 4,928,586 | * | 5/1990 | Kida | 101/230 X |

FOREIGN PATENT DOCUMENTS

| | | |
|---|---|---|
| 101 337 | 11/1973 | (DE) . |
| 2 305 132 | 8/1974 | (DE) . |
| 23 54 418 A1 | 5/1975 | (DE) . |
| 24 51 987 A1 | 9/1975 | (DE) . |
| 38 29 626 C2 | 8/1992 | (DE) . |
| 44 34 778 C1 | 11/1995 | (DE) . |
| 0 225 567 Z2 | 6/1987 | (EP) . |
| 0 563 746 A1 | 10/1993 | (EP) . |
| 0 706 881 A1 | 4/1996 | (EP) . |
| 1 462 745 | 1/1977 | (GB) . |

* cited by examiner

*Primary Examiner*—Christopher P. Ellis
*Assistant Examiner*—Kenneth W Bower
(74) *Attorney, Agent, or Firm*—Herbert L. Lerner; Laurence A. Greenberg; Werner H. Stemer

(57) ABSTRACT

A device for transferring to a downline sheet-guiding cylinder of a reversing device in a sheet-fed rotary printing machine, a trailing edge of a sheet guided on an upline sheet-guiding cylinder, includes at least one lifting device for lifting the trailing edge of the sheet from the upline sheet-guiding cylinder, and a gripper device disposed on the downline sheet-guiding cylinder, the gripper device having a gripper pad extensible out of the periphery of the downline sheet-guiding cylinder for receiving the trailing edge of the sheet from the lifting device outside the periphery, and retractable into the periphery of the downline sheet-guiding cylinder after receiving the trailing edge of the sheet, the lifting device being at least one adjustable blowing nozzle disposed in a stationary manner or on the upline sheet-guiding cylinder, for blowing air beneath the trailing edge of the sheet; and a method of transferring the trailing edge of the sheet.

20 Claims, 1 Drawing Sheet

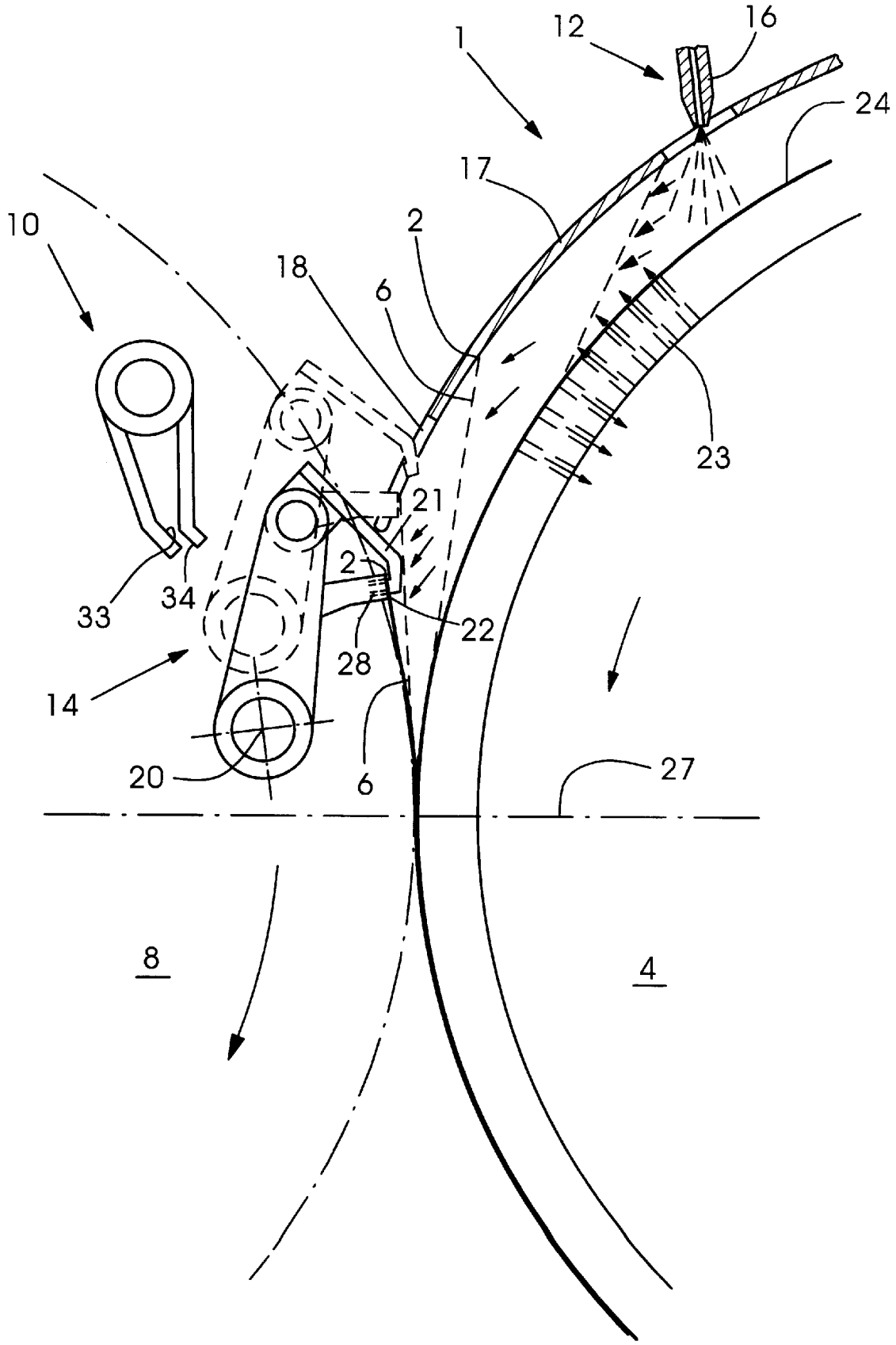
1
12
16
24
17
10
2
18
6
23
21
2
33
34
22
28
14
20
6
27
8
4

METHOD AND DEVICE FOR TRANSFERRING A TRAILING EDGE OF A SHEET IN A REVERSING DEVICE OF A SHEET-FED ROTARY PRINTING MACHINE

BACKGROUND OF THE INVENTION

Field of the Invention

The invention relates to a method and device for transferring a trailing edge of a sheet in a reversing device of a sheet-fed rotary printing machine.

In order to print both sides of sheet-like material in a sheet-fed rotary printing machine during a recto/verso or first-form and perfecter printing operation, it is necessary for the sheet to be reversed or turned by a reversing or turning device following a printing of the upper side of the sheet, in order to be able then to print on the reverse side thereof.

The German Published Non-prosecuted Patent Application (DE-OS) 24 51 987 discloses a reversing device with which, during a recto/verso printing operation, the trailing edge of a sheet guided on an impression cylinder is gripped by a suction gripper that is swivellable or pivotable out of the periphery of a downline sheet-guiding cylinder, and is guided into the periphery of the downline sheet-guiding cylinder before passing the transfer center between the two cylinders. In the periphery of the downline sheet-guiding cylinder, the trailing edge of the sheet is then transferred to a further gripper arrangement which transfers the trailing edge of the sheet to a third gripper arrangement, which is likewise arranged in a pivotable or swivellable manner within the periphery. In order to counter a relative movement between the trailing edge of the sheet and the sheet parts which continue to adhere to the impression cylinder, the relative movement leading to errors in register, the suction gripper is guided on a trochoidal path as it is retracted into the periphery of the downline sheet-guiding cylinder. Due to the transfer of the trailing edge of the sheet, which takes place in the interior of the periphery, and due to the complexity of the gear mechanisms used, in-register transfer is not possible when the aforedescribed reversing device is used, in particular at high production speeds. Furthermore, in the case of the aforedescribed device, the sheets, in particular, having greater paper weights, have a tendency, due to centrifugal force, to undergo bulge formation in the trailing part thereof which has been lifted from the impression cylinder by the suction grippers, and this bulge formation forms an additional obstacle to an in-register receiving or takeover operation by the downline gripper devices.

The published German Patent Document DE 38 29 626 C2 describes a sheet-fed rotary printing machine with a reversing device with which, during a recto/verso printing operation, the trailing edge of the sheet is lifted from the upline impression cylinder by a suction gripper that is pivotable or swivellable out of the periphery of a downline sheet-guiding cylinder. When the suction gripper is retracted beneath the periphery of the downline sheet-guiding cylinder, the movement of the suction gripper is controlled by a gear mechanism so that the sheets are subjected to tension or tautened counter to the direction of rotation of the downline sheet-guiding cylinder.

The transfer of the trailing edge of the sheet by the suction grippers within the periphery of the downline sheet-guiding cylinder means that, in the case of the devices according to the German Patent Document DE 38 29 626 C2 and the published Non-prosecuted German Patent Application (DE-OS) 24 51 987, comparatively large relative movements take place between the sheets and the interior gripper devices and, if the grippers and suckers which are used do not follow on, the large relative movements may result, for example, in so-called "picking", because the gripper retaining the leading edge of the sheet remains closed, which, in turn, is associated with serious register-related problems. Furthermore, an irregular gripper closure or an irregular gripper opening, as often occur between the drive side and the operator side of a sheet-fed rotary printing machine due to the elasticity of the gripper shafts, may result in "picking" at discrete points in time between the drive side and the operator side. The causes of the different grips or gripper lockings are dynamic in nature and are brought about, for example, by different gripper-shaft torsion, differences in rotational speed, and so forth. Furthermore, in particular in the case of thick printing materials, a twisting of the sheets which causes register errors may occur. This twisting can be attributed to the fact that the joint grip between the opening of the leading-edge gripper of the impression cylinder and the closure of the trailing-edge gripper, which is usually in the region of approximately 1 to 2 degrees of machine angle, is increased further due to the greater thickness of the printing materials.

SUMMARY OF THE INVENTION

It is accordingly an object of the invention to provide a method and a device for transferring the trailing edge of a printed sheet in a reversing device of a sheet-fed rotary printing machine which avoid the disadvantages of the prior art and ensure in-register transfer of the trailing edge of the sheet even at high production speeds and during a processing of printing materials of considerable thickness.

With the foregoing and other objects in view, there is provided, in accordance with one aspect of the invention, a device for transferring to a downline sheet-guiding cylinder of a reversing device in a sheet-fed rotary printing machine, a trailing edge of a sheet guided on an upline sheet-guiding cylinder, the transfer device comprising at least one lifting device for lifting the trailing edge of the sheet from the upline sheet-guiding cylinder, and a gripper device disposed on the downline sheet-guiding cylinder, the gripper device having a gripper pad extensible out of the periphery of the downline sheet-guiding cylinder for receiving the trailing edge of the sheet from the lifting device outside the periphery, and retractable into the periphery of the downline sheet-guiding cylinder after receiving the trailing edge of the sheet, the lifting device being at least one adjustable blowing nozzle disposed in a manner selected from the group consisting of a stationary manner and a manner wherein it is mounted on the upline sheet-guiding cylinder, for blowing air beneath the trailing edge of the sheet.

In accordance with another aspect of the invention, there is provided a device for transferring to a downline sheet-guiding cylinder of a reversing device in a sheet-fed rotary printing machine, a trailing edge of a sheet guided on an upline sheet-guiding cylinder, the transfer device comprising at least one lifting device for lifting the trailing edge of the sheet from the upline sheet-guiding cylinder, and a gripper device disposed on the downline sheet-guiding cylinder, the gripper device having a gripper pad extensible out of the periphery of the downline sheet-guiding cylinder for receiving the trailing edge of the sheet from the lifting device outside the periphery, and retractable into the periphery of the downline sheet-guiding cylinder after receiving the trailing edge of the sheet, the lifting device being at least one adjustable blowing nozzle disposed in a stationary manner and directed towards the upline sheet-guiding cylinder for blowing air beneath the trailing edge of the sheet.

In accordance with a further aspect of the invention, there is provided a device for transferring to a downline sheet-guiding cylinder of a reversing device in a sheet-fed rotary printing machine, a trailing edge of a sheet guided on an upline sheet-guiding cylinder, the transfer device comprising at least one lifting device for lifting the trailing edge of the sheet from the upline sheet-guiding cylinder, and a gripper device disposed on the downline sheet-guiding cylinder, the gripper device having a gripper pad extensible out of the periphery of the downline sheet-guiding cylinder for receiving the trailing edge of the sheet from the lifting device outside the periphery, and retractable into the periphery of the downline sheet-guiding cylinder after receiving the trailing edge of the sheet, the lifting device being a plurality of blowing nozzles disposed on the upline sheet-guiding cylinder for blowing air beneath the trailing edge of the sheet.

In accordance with an added aspect of the invention, there is provided a device for transferring to a downline sheet-guiding cylinder of a reversing device in a sheet-fed rotary printing machine, a trailing edge of a sheet guided on an upline sheet-guiding cylinder, the transfer device comprising at least one lifting device for lifting the trailing edge of the sheet from the upline sheet-guiding cylinder, and a gripper device disposed on the downline sheet-guiding cylinder, the gripper device having a gripper pad extensible out of the periphery of the downline sheet-guiding cylinder for receiving the trailing edge of the sheet from the lifting device outside the periphery, and retractable into the periphery of the downline sheet-guiding cylinder after receiving the trailing edge of the sheet, the lifting device being at least one blowing nozzle disposed in a stationary manner and directed towards the upline sheet-guiding cylinder for blowing air beneath the trailing edge of the sheet, and a plurality of blowing nozzles disposed on the upline sheet-guiding cylinder for additionally blowing air beneath the trailing edge of the sheet.

In accordance with an additional feature of the invention, the transfer device includes a sheet-guiding element disposed upline of a location at which the sheet trailing edge is received by the gripper device.

In accordance with yet another feature of the invention, the sheet-guiding element is disposed a spaced distance from the periphery of the upline sheet-guiding cylinder corresponding to a spaced distance between the gripper pad and the upline sheet-guiding cylinder in a transfer region of the trailing edge of the sheet.

In accordance with yet a further feature of the invention, the sheet-guiding element is formed with an engagement opening through which the gripper device of the downline sheet-guiding cylinder engages.

In accordance with yet an added feature of the invention, the gripper device includes the gripper pad and a gripper finger.

In accordance with yet an additional feature of the invention, the gripper pad has suction nozzles for retaining the trailing edge of the sheet.

In accordance with still another feature of the invention, the suction nozzles have a suction force that is adjustable so that the trailing edge of the sheet can move relative to the gripper pad.

In accordance with still a further feature of the invention, the upline sheet-guiding cylinder is an impression cylinder having a covering that is air-permeable at least in a region having blowing and suction openings.

In accordance with a concomitant aspect of the invention, there is provided a method of transferring a trailing edge of a sheet guided on an upline sheet-guiding cylinder to a gripper device for receiving the trailing edge of the sheet, the gripper device having gripper pads and being disposed on a downline sheet-guiding cylinder in a reversing device of a sheet-fed rotary printing machine, which comprises the steps of lifting the trailing edge of the sheet away from the upline sheet-guiding cylinder by blowing devices; guiding the trailing edge of the sheet by a guiding device; extending the sheet-gripper pads of the gripper device out of the periphery of the downline sheet-guiding cylinder; receiving the trailing edge of the sheet from the guiding device and retaining it outside the periphery by the sheet-gripper pads; tautening the sheet before the gripper device is firmly closed; and then retracting the sheet-gripper pads into the periphery of the downline sheet-guiding cylinder and subsequently transferring the trailing edge of the sheet from the firm grip of the gripper device into a firm grip of the reversing device.

The transfer device according to the invention offers the advantage that a gear mechanism for moving a removal device, such as a suction gripper, for example, can be dispensed with.

In an advantageous configuration, the trailing edge of the sheet is loosened by the use of blowing air which is directed beneath the trailing edge of the sheet by blowing nozzles. Alternatively, or as a supporting measure, it is possible to provide in the sheet-transporting cylinder, e.g., an impression cylinder, blowing-air openings which lift the trailing edge off the cylinder. In order to guide the trailing edge on a defined path, a sheet-guiding device is provided whereon the trailing edge of the sheet positions itself. Distributed over the axial length of the sheet-guiding device are engagement openings through which a sheet-receiving gripper of the reversing drum can engage, in order to grip the trailing edge of the sheet. In an advantageous configuration, a gripper pad of the sheet-receiving gripper may be provided with suction openings which allow relative movement of the trailing edge of the sheet before the gripper device is firmly closed.

Other features which are considered as characteristic for the invention are set forth in the appended claims.

Although the invention is illustrated and described herein as embodied in a method and device for transferring the trailing edge of a sheet in a reversing device of a sheet-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, wherein:

BRIEF DESCRIPTION OF THE DRAWINGS

The single FIGURE is a fragmentary diagrammatic side elevational view of an upline sheet-guiding cylinder and a downline sheet-guiding cylinder of a reversing or turning device with a device according to the invention for transferring the trailing edge of a sheet guided on the upline sheet-guiding cylinder.

DESCRIPTION OF THE PREFERRED EMBODIMENTS

Referring now more particularly to the single FIGURE of the drawing, there is shown therein a device 1 according to the invention for transferring to a downline sheet-guiding cylinder 8 of a reversing or turning device 10 a sheet 6 by a trailing edge 2 thereof, the sheet 6 being guided on an upline sheet-guiding cylinder 4. The transferring device 1 includes a sheet-lifting device 12, and a gripper device 14 that is disposed on the downline sheet-guiding cylinder 8. According to the invention, the sheet-lifting device 12 includes at least one blowing nozzle 16, but preferably a plurality of blowing nozzles 16 which are distributed over the axial length and/or in the circumferential direction of the upline cylinder, e.g. an impression cylinder 4, the blowing nozzles 4 being directed onto the cylinder 4 for the purpose of blowing air beneath the trailing edge 2. The blowing nozzles 16 are arranged in a region up to approximately 90° before a line 27 connecting the center lines of the cylinders 4 and 8. The blowing nozzles 16 are mounted so that they are adjustable in order to change the blowing direction, depending upon the thickness of the paper to be processed. It is also possible to adjust the blowing-air pressure and the quantity of blowing air. A sheet-guiding device 17, e.g. in the form of a sheet-guiding plate, is provided at a small spaced distance from the periphery of the upline cylinder 4 and defines a movement path for the trailing edge 2 of the sheet 6, the trailing edge 2, after having been lifted from the impression cylinder 4, positioning itself on the sheet-guiding device 17. Distributed over the axial length, the sheet-guiding device 17 formed with a plurality of engagement openings 18 through which the gripper device 14 can engage with the sheet 6 in order to grip the trailing edge 2 thereof.

Substantially simultaneously with the lifting of the trailing edge 2 of the sheet by the blowing device 12, the sheet-gripper device 14 is extended out of the periphery of the downline sheet-guiding cylinder 8. In the preferred embodiment of the invention, the gripper device 14 is pivoted or swivelled about an axis of rotation 20 by a non-illustrated cam gear mechanism. The gripper device 14 is primarily formed of a number of gripper fingers 21 and gripper pads 22 cooperating therewith.

The gripper pad 22 extended out of the periphery of the downline sheet-guiding cylinder 8 receives or takes over, from the guiding device 17, the trailing edge 2 of the sheet 6 outside the periphery of the downline sheet-guiding cylinder 8. In this regard, in the region wherein the gripper pad 22 receives the trailing edge 2 of the sheet 6, the spacing between the gripper pad 22 and the cylinder 4 corresponds approximately to the spacing of the guiding device 17 from the cylinder 4. This measure means that the trailing edge 2 of the sheet 6 is transferred smoothly from the guiding device 17 to the gripper support 22. The gripper pad 22 receives the trailing edge 2 of the sheet preferably on, or in the region of, a line which runs between the peripheries of the cylinders 4 and 8 and disposed perpendicularly to the imaginary line 27 connecting the centers of rotation of the cylinders 4 and 8. In the interest of simplicity, this line that is unidentified by any reference numeral is referred to hereinbelow as a tangent line, although, in precise terms, it is located in the center of the gap that is formed between the two surfaces of the cylinders 4 and 8 and that may have, for example, a gap width of several tenths of a mm. During transfer of the trailing edge 2 of the sheet to the gripper pad 22, the latter is preferably at rest relative to the downline cylinder 8.

It is proposed that the gripper device 14 subject the trailing edge 2 of the sheet 6 initially to just a slight closing pressure, so that the trailing edge 2 of the sheet 6 can move relative to the gripper pad 22. This measure tensions or tautens the sheet 6. After the sheet 6 has been tautened, the gripper device 14 is firmly closed and then transfers the sheet 6, in a tension-free and compression-free manner, to the downline tongs gripper 10.

Alternatively, or as a supporting measure for the proposed slight closing pressure, the gripper pad 22 may be provided with suction openings 28 which retain the sheet 6 by negative pressure, although the latter is adjusted so as to allow relative movement during tensioning or tautening of the sheet 6, before the gripper device 14 is firmly closed.

After the trailing edge 2 of the sheet has been gripped and the leading edge of the sheet has been released, the gripper device 14 is pivoted back about the axis 20 so that the sheet-gripper device 14, retaining the trailing edge 2 of the sheet, is retracted into the periphery of the downstream sheet-guiding cylinder 8 before it passes the line 27.

The gripper device 14 then transfers the trailing edge 2 of the sheet 6 to the gripper device 10, which may be constructed, for example, as a pivotable tongs-gripper device 10 disposed within the periphery of the downline sheet-guiding cylinder 8. Moreover, the further gripper device 10 may have angled-away sheet-retaining surfaces 33 and 34 and, during further rotation of the cylinders 4 and 8, is preferably pivoted so that, after the pivoting, the trailing edge 2 of the sheet 6 runs directly in the region of the periphery of the downline sheet-guiding cylinder 8. This makes it possible for the trailing edge 2 of the inverted or turned sheet 6 then to be transferred in a conventional manner to a non-illustrated heretofore known gripping device of another downline sheet-guiding cylinder, for example, an impression cylinder, in a downline printing unit.

In order to assist the lifting of the trailing edge 2 of the sheet 6 from the upline cylinder 4, the latter may be provided, in the region of the trailing edge 2 of the sheet 6, with a plurality of small blowing and suction openings 23 which cause the trailing edge 2 of the sheet 6 to be lifted off and the blowing nozzles 12 to be assisted, respectively, it being possible, depending upon the format length of the sheet, for the blowing openings 23 which are respectively arranged in the region of the trailing edge of the sheet to have blowing air admitted thereto and for the suction openings 23 to have suction air admitted thereto. This measure ensures that only a specific trailing-edge region of the sheet 6 is lifted away from the cylinder 4 in order to position itself with the trailing edge 2 on the guiding plate 17.

If the cylinder 4 is constructed as an impression cylinder, provision is made for the blowing and suction openings 23 to be covered by an air-permeable covering 24, e.g., a porous film or foil of plastic material or metal.

We claim:

1. A device for transferring to a downline sheet-guiding cylinder of a reversing device in a sheet-fed rotary printing machine, a trailing edge of a sheet guided on an upline sheet-guiding cylinder, the transfer device comprising:

at least one lifting device for lifting the trailing edge of the sheet from the upline sheet-guiding cylinder, and a gripper device disposed on the downline sheet-guiding cylinder, said gripper device having a gripper pad extensible out of the periphery of the downline sheet-guiding cylinder for receiving the trailing edge of the sheet from said lifting device outside the periphery, and retractable into the periphery of the downline sheet-guiding cylinder after receiving the trailing edge of the sheet;

a sheet-guiding element disposed upline of a location at which the sheet trailing edge is received by said gripper device;

said lifting device being at least one adjustable blowing nozzle disposed in a manner selected from the group consisting of a stationary manner wherein it is directed towards the upline sheet-guided cylinder and a manner wherein it is mounted on the upline sheet-guiding cylinder, for blowing air beneath the trailing edge of the sheet and positioning the trailing edge of the sheet on said sheet-guiding element such that said gripper device can grip said trailing edge of the sheet.

2. The transfer device according to claim 1, wherein the upline sheet-guiding cylinder is an impression cylinder having a covering that is air-permeable at least in a region having blowing and suction openings.

3. The transfer device according to claim 1, wherein said sheet-guiding element is disposed a spaced distance from the periphery of the upline sheet-guiding cylinder corresponding to a spaced distance between said gripper pad and the upline sheet-guiding cylinder in a transfer region of the trailing edge of the sheet.

4. The transfer device according to claim 3, wherein said sheet-guiding element is formed with an engagement opening through which said gripper device of the downline sheet-guiding cylinder engages.

5. The transfer device according to claim 4, wherein said gripper device includes said gripper pad and a gripper finger.

6. The transfer device according to claim 5, wherein said gripper pad has suction nozzles for retaining the trailing edge of the sheet.

7. The transfer device according to claim 6, wherein said suction nozzles have a suction force that is adjustable so that the trailing edge of the sheet can move relative to said gripper pad.

8. A transfer device for transferring a trailing edge of a sheet guided on an upline sheet-guiding cylinder, comprising:

a sheet-guiding element disposed a spaced distance from the periphery of said upline sheet-guiding cylinder; and at least one lifting device for lifting the trailing edge of the sheet from a upline sheet-guiding cylinder, said lifting device being at least one adjustable blowing nozzle disposed in a stationary manner and directed towards the upline sheet-guiding cylinder for blowing air beneath the trailing edge of the sheet and positioning the trailing edge of the sheet on said sheet-guiding element.

9. The transfer device according to claim 8, wherein said spaced distance from the periphery of the upline sheet-guiding cylinder to the sheet-guiding element corresponds to a spaced distance between said gripper pad and the upline sheet-guiding cylinder in a transfer region of the trailing edge of the sheet.

10. The transfer device according to claim 9, wherein said sheet-guiding element is formed with an engagement opening through which said gripper device of the downline sheet-guiding cylinder engages.

11. The transfer device according to claim 10, wherein said gripper device includes a gripper pad and a gripper finger.

12. A device for transferring to a downline sheet-guiding cylinder of a reversing device in a sheet-fed rotary printing machine, a trailing edge of a sheet guided on an upline sheet-guiding cylinder, the transfer device comprising:

at least one lifting device for lifting the trailing edge of the sheet from the upline sheet-guiding cylinder, and a gripper device disposed on the downline sheet-guiding cylinder, said gripper device having a gripper pad extensible out of the periphery of the downline sheet-guiding cylinder for receiving the trailing edge of the sheet from said lifting device outside the periphery, and retractable into the periphery of the downline sheet-guiding cylinder after receiving the trailing edge of the sheet, a sheet-guiding element disposed upline of a location at which the sheet trailing edge is received by said gripper device;

said lifting device being a plurality of blowing nozzles disposed on the upline sheet-guiding cylinder for blowing air beneath the trailing edge of the sheet and positioning the trailing edge of the sheet on said sheet-guiding element.

13. The transfer device according to claim 12, wherein said sheet-guiding element is disposed a spaced distance from the periphery of the upline sheet-guiding cylinder corresponding to a spaced distance between said gripper pad and the upline sheet-guiding cylinder in a transfer region of the trailing edge of the sheet.

14. The transfer device according to claim 13, wherein said sheet-guiding element is formed with an engagement opening through which said gripper device of the downline sheet-guiding cylinder engages.

15. The transfer device according to claim 14, wherein said gripper device includes a gripper pad and a gripper finger.

16. A device for transferring to a downline sheet-guiding cylinder of a reversing device in a sheet-fed rotary printing machine, a trailing edge of a sheet guided on an upline sheet-guiding cylinder, the transfer device comprising:

at least one lifting device for lifting the trailing edge of the sheet from the upline sheet-guiding cylinder, and a gripper device disposed on the downline sheet-guiding cylinder, said gripper device having a gripper pad extensible out of the periphery of the downline sheet-guiding cylinder for receiving the trailing edge of the sheet from said lifting device outside the periphery, and retractable into the periphery of the downline sheet-guiding cylinder after receiving the trailing edge of the sheet, a sheet-guiding element disposed upline of a location at which the sheet trailing edge is received by said gripper device;

said lifting device being at least one blowing nozzle disposed in a stationary manner and directed towards the upline sheet-guiding cylinder for blowing air beneath the trailing edge of the sheet, and a plurality of blowing nozzles disposed on the upline sheet-guiding cylinder for additionally blowing air beneath the trailing edge of the sheet and positioning the trailing edge of the sheet on said sheet-guiding element.

17. The transfer device according to claim 16, wherein said sheet-guiding element is disposed a spaced distance from the periphery of the upline sheet-guiding cylinder corresponding to a spaced distance between said gripper pad and the upline sheet-guiding cylinder in a transfer region of the trailing edge of the sheet.

18. The transfer device according to claim 17, wherein said sheet-guiding element is formed with an engagement opening through which said gripper device of the downline sheet-guiding cylinder engages.

19. The transfer device according to claim 18, wherein said gripper device includes a gripper pad and a gripper finger.

20. A method of transferring a trailing edge of a sheet guided on an upline sheet-guiding cylinder to a gripper device for receiving the trailing edge of the sheet, the gripper device having gripper pads and being disposed on a downline sheet-guiding cylinder in a reversing device of a sheet-fed rotary printing machine, which comprises the steps of lifting the trailing edge of the sheet away from the upline sheet-guiding cylinder by blowing devices; guiding the trailing edge of the sheet by a guiding device; extending the sheet-gripper pads of the gripper device out of the periphery of the downline sheet-guiding cylinder; receiving the trailing edge of the sheet from the guiding device and retaining it outside the periphery by the sheet-gripper pads; tautening the sheet before the gripper device is firmly closed; and then retracting the sheet-gripper pads into the periphery of the downline sheet-guiding cylinder and subsequently transferring the trailing edge of the sheet from t he firm grip of the gripper device into a firm grip of the reversing device.

* * * * *